US010343009B2

(12) United States Patent
Peyton

(10) Patent No.: US 10,343,009 B2
(45) Date of Patent: Jul. 9, 2019

(54) MULTI-USE EXERCISE BAG WITH REMOVEABLE WEIGHTS

(71) Applicant: Peyton Ventures, LLC, Bloomington, MN (US)

(72) Inventor: Cole Peyton, Bloomington, MN (US)

(73) Assignee: Peyton Ventures, LLC, Bloomington, MN (US)

( * ) Notice: Subject to any disclaimer, the term of this patent is extended or adjusted under 35 U.S.C. 154(b) by 230 days.

(21) Appl. No.: 15/600,154

(22) Filed: May 19, 2017

(65) Prior Publication Data

US 2018/0333603 A1 Nov. 22, 2018

(51) Int. Cl.

| | |
|---|---|
| ***A63B 21/06*** | (2006.01) |
| ***A63B 21/072*** | (2006.01) |
| ***A63B 21/075*** | (2006.01) |
| *A63B 21/00* | (2006.01) |

(52) U.S. Cl.

CPC ..... *A63B 21/072* (2013.01); *A63B 21/0602* (2013.01); *A63B 21/0603* (2013.01); *A63B 21/075* (2013.01); *A63B 21/06* (2013.01); *A63B 21/4001* (2015.10); *A63B 21/4035* (2015.10)

(58) Field of Classification Search

CPC . A63B 21/06; A63B 21/0602; A63B 21/0603; A63B 21/072; A63B 21/075; A63B 21/4001; A63B 21/4035

See application file for complete search history.

(56) References Cited

U.S. PATENT DOCUMENTS

| | | | | |
|---|---|---|---|---|
| 2,616,467 | A * | 11/1952 | Cicero | B65D 33/28 383/16 |
| 7,563,208 | B1 | 7/2009 | Chen | |
| 7,762,933 | B1 | 7/2010 | Yu | |
| 8,276,351 | B1 * | 10/2012 | Henkin | A63B 21/00058 482/89 |
| 8,550,243 | B2 * | 10/2013 | Moore | A45C 13/02 206/315.1 |
| 8,858,406 | B2 | 10/2014 | Klukas | |
| 9,320,938 | B1 * | 4/2016 | Belmore | A63B 21/075 |
| 9,387,356 | B2 * | 7/2016 | Jaidar | A63B 15/00 |

(Continued)

FOREIGN PATENT DOCUMENTS

| | | | |
|---|---|---|---|
| CN | 204261297 | U | 4/2015 |
| CN | 105056465 | A | 11/2015 |
| CN | 204767287 | U | 11/2015 |

*Primary Examiner* — Joshua Lee

(74) *Attorney, Agent, or Firm* — Peter J. Ims; Westman, Champlin & Koehler, P.A.

(57) ABSTRACT

An exercise kit includes an outer bag having a cover and a cavity therein configured to receive one or more removable weights therein. The outer bag has a plurality of spaced apart handles positioned in one or more directions along the outer bag, allowing the bag to be used in one more different exercises. The kit includes a plurality of weight bags, which are fillable by a user to form the removable weights. The weight bags have a closure mechanism having connectable ends that each extend beyond the length of the opening of the weight bag, such that when the inner bags are each filled to a fill level indicative of a selected weight, the opening can be folded over, the bag compressed to remove excess air, and the opening rolled down to the filling. The connectable ends are then connected to form an integral handle portion of the removable weight.

15 Claims, 5 Drawing Sheets

(56) References Cited

U.S. PATENT DOCUMENTS

| | | | | |
|---|---|---|---|---|
| 9,446,283 | B2 | 9/2016 | Nelson | |
| D792,531 | S * | 7/2017 | Bossier | D21/682 |
| 9,999,798 | B2 * | 6/2018 | Hannula | A63B 21/065 |
| D823,953 | S * | 7/2018 | Kuka | D21/680 |
| 10,149,997 | B1 * | 12/2018 | Henniger | A63B 21/0603 |
| 2005/0187075 | A1 * | 8/2005 | Bellamy | A63B 21/0004 482/93 |
| 2007/0049469 | A1 * | 3/2007 | Brown | A45C 3/00 482/93 |
| 2008/0023355 | A1 * | 1/2008 | Reynolds | A63B 71/0036 206/315.1 |
| 2009/0062085 | A1 | 3/2009 | Polevoy et al. | |
| 2010/0048363 | A1 * | 2/2010 | Gilberti | A63B 21/0603 482/105 |
| 2012/0149536 | A1 | 6/2012 | Trimble et al. | |
| 2012/0252641 | A1 | 10/2012 | Odneal et al. | |
| 2012/0322627 | A1 * | 12/2012 | Emerson | A63B 21/075 482/93 |
| 2013/0040789 | A1 | 2/2013 | Kessler | |
| 2013/0072357 | A1 * | 3/2013 | Galvan | A63B 69/34 482/83 |
| 2013/0157815 | A1 * | 6/2013 | Reynolds | A63B 21/072 482/93 |
| 2013/0244843 | A1 | 9/2013 | Burwell et al. | |
| 2013/0337980 | A1 | 12/2013 | Himmelrick et al. | |
| 2014/0024507 | A1 | 1/2014 | Hagos | |
| 2015/0051053 | A1 * | 2/2015 | Conen | A63B 21/0602 482/108 |
| 2015/0196792 | A1 | 7/2015 | Towley et al. | |
| 2015/0343256 | A1 * | 12/2015 | Coompol | A63B 21/0724 482/93 |
| 2016/0129292 | A1 * | 5/2016 | Stroup | A63B 21/00065 482/93 |
| 2018/0140897 | A1 * | 5/2018 | Hetrick | A63B 22/20 |

* cited by examiner

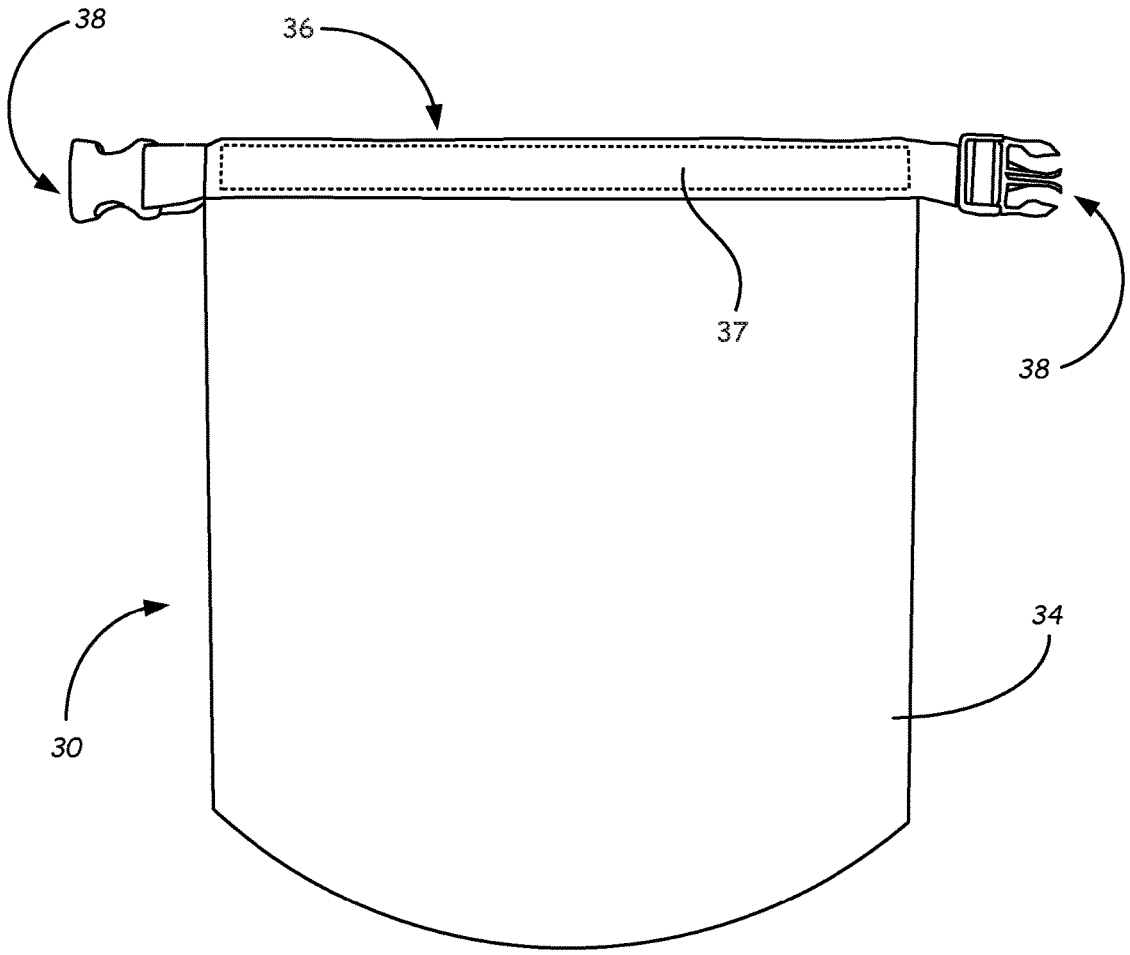
FIG. 4A
FIG. 5A
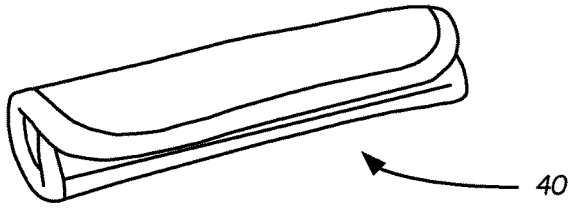

MULTI-USE EXERCISE BAG WITH REMOVEABLE WEIGHTS

BACKGROUND

The present invention relates to a multi-use exercise bag, and more particularly to an exercise bag and removable weight system where the removable weights can be used individually or stacked within the exercise bag.

Various types of equipment and apparatuses are used by people to exercise. Non-limiting examples of equipment include free weights, plate loaded machines, and/or elastic bands for exercising and building muscle. Weighted bags may also be incorporated into routines for aerobic training and sport training. Most of this equipment is typically not portable and must be used in the home or at a gym or health club. Further, most of the equipment is single use equipment and is used to target one muscle or one muscle group only. The user is limited to exercising with the fixed weight of the material determined and provided by the manufacturer.

Many dumbbells and kettlebells have a solid metal, or similar material, construction. Some dumbbells and kettlebells are pre-filled with the sand or other material at the point of manufacture and are sewn or sealed shut and then shipped to the user. In either instance, the user cannot manipulate or adjust the usage of these devices. The costs of shipping these devices can be substantial due to the weight being shipped.

There are many weight lifting and exercise devices that have also utilized sand or other weighted filler materials to provide weight for resistance. These products may be shipped unfilled, but generally come in one standard size such that the user cannot manipulate the total weight.

SUMMARY

An aspect of the present disclosure relates to an exercise kit comprising a multi-use exercise bag with removable weights. An outer bag is of a size sufficient to receive one or more removable weights within an interior region. The outer bag has a plurality of spaced apart handles secured to an outer surface thereof. A plurality of removable weights are configured to be positioned, one on top of the other, within the interior region of the outer bag. Each inner bag has a closure mechanism secured along its opening. The inner bags are marked with a fill level near the opening such that each inner bag is fillable to a selected overall weight. Once filled and closed, the weights formed are kettlebells, with a material such that the kettlebells are soft-sided weights having an integral handle.

The interior cavity of the outer bag is configured to accept a plurality of kettlebell weight bags therein. By way of example, one or more of the removable weights, for example, three weights having the same or different overall weights, are stacked inside the outer bag. The outer bag includes a cover securable to the opening of the outer bag by way of a zipper closure. The plurality of handles on the outer bag allow a user to lift, drag, pull or push the outer bag with one or more of the weights therein. The handles are positioned on the outside of the outer bag to allow the user to use the outer bag with or without the weights therein for various selected exercised working different muscle groups.

Another aspect of the present disclosure relates to a method of using the kit for various exercises. The method comprises filling a plurality of weight bags with a material for providing weight to the bags. A fill level indicator is located on a surface of each of the weight bags. The fill level indicator line corresponds to a selected overall weight for forming each one of a plurality of different weights when filled. The method further comprises gripping a handle portion of one of the plurality of weights for lifting the weight for exercising. An outer bag is configured to receive the plurality of removable weights therein. Placing one or more of the plurality of removable weights in the outer bag and closing the outer bag allows the user to select the total weight of the multi-use exercise bag by stacking selected removable weights therein. The handles positioned around and along the exterior surface of the outer bag allow the user to grip one or more spaced apart handles for various exercises.

The one or more removable weights are formed by filling each of the plurality of weight bags with a filling material. A nylon or polyester webbing is attached to one side of an opening of the weight bag. Opposing ends of this webbing terminate in interlocking mechanisms. Once the weighted bag is filled to the selected level, the weights are formed by folding over the opening of the inner bag at least one time. The weight bag is then compressed to force excess air from above the filling material from the bag. The opening and the webbing are then rolled down the bag and the interlocking mechanism and connected, where connecting the interlocking mechanism forms a handle for the removable weight.

BRIEF DESCRIPTION OF THE DRAWINGS

FIG. 4A is a front view of an unfilled weight bag.

FIG. 5A is a perspective view of a removable handle in closed manner for use with the removable weight.

DETAILED DESCRIPTION

The multi-use exercise system includes an outer bag having a plurality of handles in different locations and orientations secured to an outer surface. The outer bag is configured to receive one or more removable weights therein. The removable weights can be stacked within an interior region of the outer bag, allowing a user to utilize the exercise bag for various weight training and fitness exercises. The removable weights can also be removed from the outer bag and used individually as kettlebell weights for additional weight training or fitness exercises.

Figure 1:
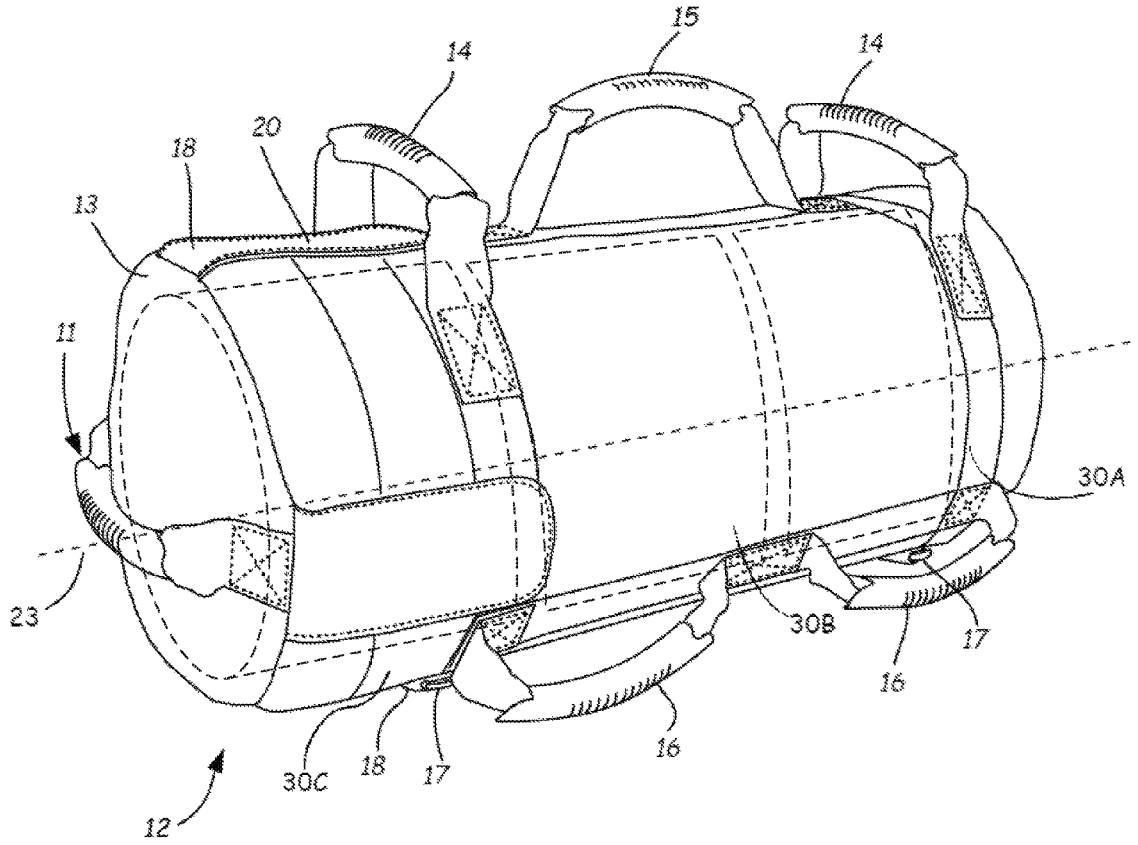
FIG. 1 is a perspective view of an outer bag of a multi-use exercise kit.
Figures 2, 6:
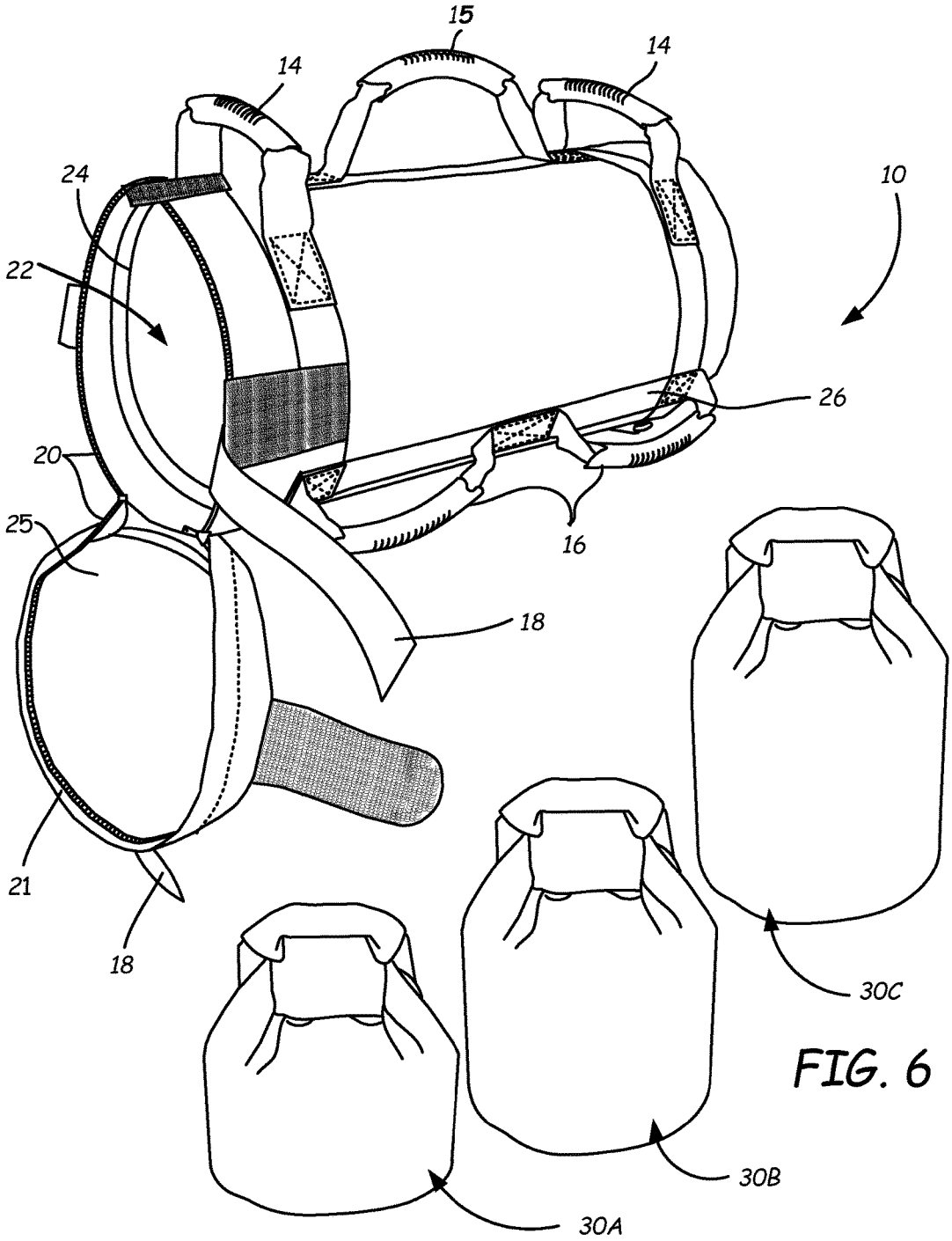
FIG. 2 is a perspective view of a multi-use exercise kit including removable weights and the outer bag with an opening exposed to an interior region of the outer bag.
FIG. 6 illustrates a set of removable weights for stacking within the outer bag of FIG. 2.
Figure 3:
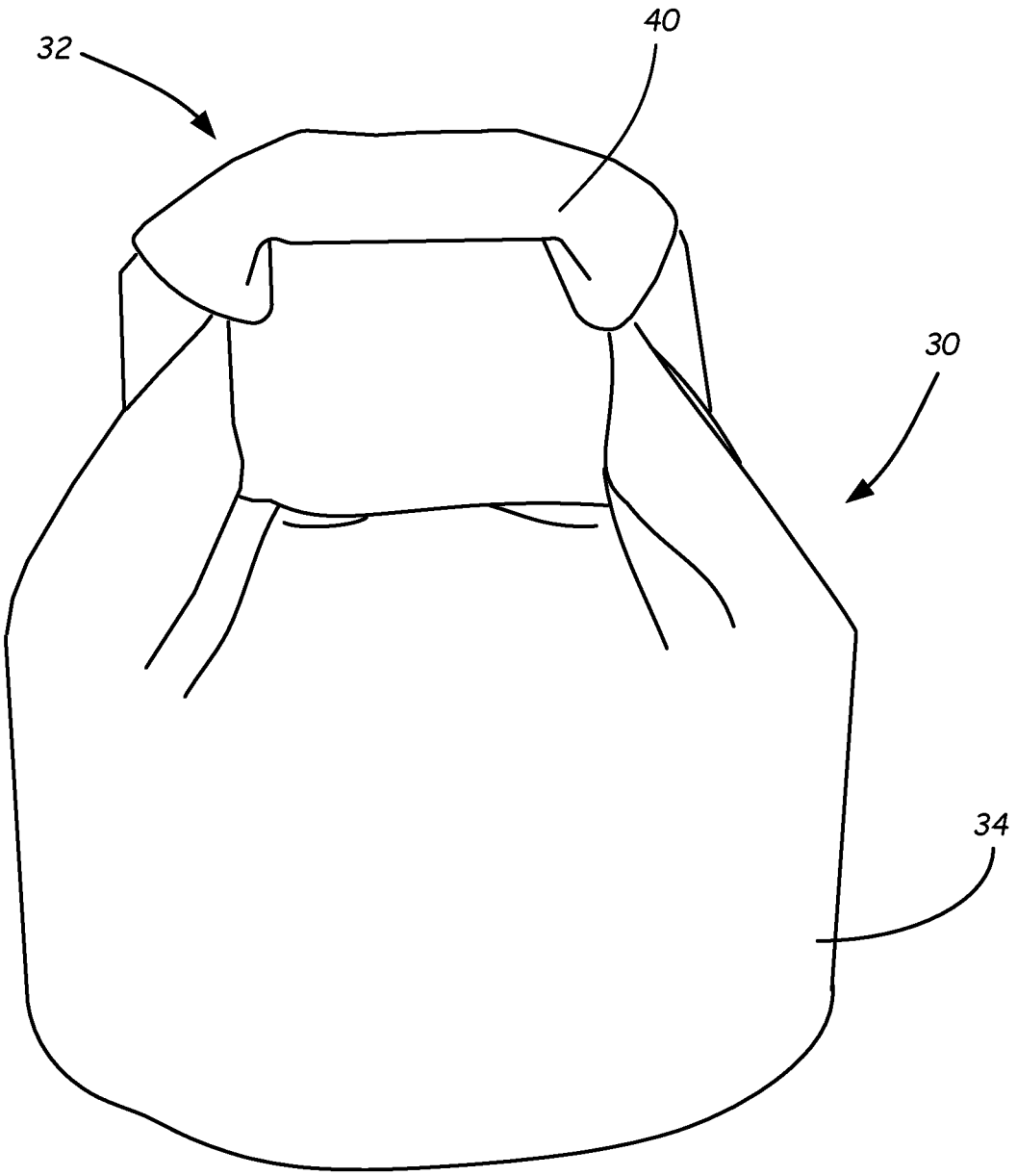
FIG. 3 is a front view of a removable weight.

Referring to FIGS. 1-2, a kit 10 includes an outer bag 12 having a cover 13 that is securable to the body of the outer bag 12 via a zipper 20 around an opening to an interior cavity 22 within the outer bag 12. The zipper utilized is a heavy duty zipper, such as those supplied by YKK Group, Tokyo, Japan. When the cover 13 is secured to the outer bag 12 and closed, the zipper 20 is covered by a flap 21 that co-extends around the cover 13 to conceal the zipper 20 when the cover 13 is secured to the outer bag 12. By way of non-limiting example, the flap 21 may be approximately ½ inches in width from the zipper 21 to the edge of the cover 13. While a zipper is illustrated, other securing mechanism are within the scope of the present disclosure.

Additional closure securing mechanisms 18 are configured to extend around the cover 13 and over the closure 20 to further retain the cover 13 in a closed manner, as illustrated in FIG. 1. The closure securing mechanisms 18 may be nylon or polyester webbing flaps or straps 18 that are attached at one end to the cover 13 or to the body of the outer bag 12 and are removably securable at an opposing end to the body of the outer bag 12 or the cover respectively using a hook and loop fastening system. While a hook and loop fastening system is disclosed, other securing mechanism are within the scope of the present disclosure.

The outer bag 12 also includes a liner 24 that is secured to an inner surface of the outer bag 12 such that the liner 24 defines the cavity 22. The liner 24 also covers a bottom or base of the outer bag 12. An inner surface of the cover 13 also has a liner 25 secured thereto. The liners 24, 25 provide stability and rigidity to the bag 12 and cover 13, respectively and maintain the overall shape of the bag regardless of the number of weights or the total weight of the removable weights 30 placed therein. The liners 24, 25 provide a cushion between the outer surfaces of the removable weights 30 stacked therein to provide protection to the user. By way of non-limiting example, the liner 24 can be a foam padding. In the embodiment illustrated, the liner 24 is approximately 1¼ inch thick. Examples of foam padding material include, but are not limited to, re-bond foam. However, other padding materials and thicknesses are within the scope of the present disclosure.

The exterior layer, or shell, of the outer bag 12 and cover 13 are constructed of an abrasion, mildew, and water resistant material. Examples of materials include, but are not limited to, a vinyl fabric, and/or a polyvinylchloride (PVC) material, such as PVC coated fabrics or fibers.

A plurality of handles 11, 14, 16 are secured to an exterior surface of the outer bag 12 in various locations and orientations. A length of nylon or polyester webbing 26 is secured the exterior layer of the bag 12 and sewn thereto. The handles are then secured to the webbing 26, to ensure that the handles are fixedly secured to the outer bag 12.

As illustrated in FIGS. 1-2, the plurality of handles includes a first handle 11 that is secured to the exterior layer of the cover 13. The outer bag 12 also has one or more handles 15, 16 secured to the exterior layer of the bag 12, in one or more spaced apart positions parallel to an axis 23 that extends along a length of the bag, from the cover to a second end of the bag. A pair of handles 14, is also secured to the exterior layer of the bag 12 and positioned transverse to the axis 23. For examples, the handles 14 are positioned on opposing ends of the bag 12. Additional handles may be secured to the exterior layer of the outer bag 12 in an orientation angled with respect to the axis 24. This may include spaced apart handles oriented at substantially complimentary angles with respect to one another. Additional or alternative positioning of handles with respect to the axis 23 is contemplated by this disclosure.

The handle 15 is secured to the exterior layer of the outer bag 12 in a position substantially parallel to axis 23 and is located at a position that is offset from a center of the bag 12 along the axis 23, where the handle 15 is positioned proximate the center of gravity when the bag 12 is loaded with the removable weights 30. A pair of spaced apart handles 16 are substantially parallel to the axis 23 and are spaced apart from the handles 14, 15. The handle 11 is oriented substantially across the diameter of the cover 13. The handles 14 are secured to the exterior layer of the outer bag 12 in a position substantially transverse to the axis 23 and are spaced apart from one another. The various handles 11, 14, 15, and 16 and their respective orientation and location on the outer bag 12 allow the user to select which handles 11, 14, 15, 16 to use for a selected workout, to engage different selected muscle groups, and/or to enable different body movements for weightlifting or fitness.

The outer surface of the bag 12 may also adapted with hooks or clips 17 which are accessories attachment clips. The clips may allow the bag to be connected to pre-existing exercise equipment for additional uses, or may be used to adapt the outer bag 12 with back-pack straps (not shown).

As mentioned previously, the outer bag 12 is configured to receive a plurality of removable weights 30 therein. In the embodiment illustrated, the outer bag 12 has dimensions sufficient to receive and support three removable weights 30 within the cavity 22. The removable weights 30 are portable kettlebells 30A, 30B, 30C, each having a different total weights. As referred to throughout this disclosure, kettlebells are ball shaped weights having a single handle, wherein the handle forms an integral loop with the ball of the weight. The terms "removable weights" and "kettlebells" are used interchangeably throughout this disclosure and refer to the same device. The kit 10 thus provides a user with a selection of weights to use depending on the user's selected workout or fitness level as the exercise kit 10. The removable weights 30 that can be removed from the bag 12 and used separately. As illustrated in FIGS. 1-2, the removable weights 30 are stackable within the cavity 22 of the outer bag 12, and thus the weight of the multi-use exercise bag 12 can selected and/or adjusted.

Referring now to FIGS. 3-6, each removable weight 30A, 30B, 30C is a soft sided weight or kettlebell, meaning that the weight itself does not comprise any metal components or hard surfaces. The kettlebells are "soft sided" in that the walls of the kettlebell flex, even when the weights are filled with the filling material.

The weight bags 34 may be constructed of an abrasion, mildew and water resistant material. Examples of materials include, but are not limited to, a vinyl fabric, and/or a polyvinylchloride (PVC) material, such as PVC coated fabrics or fibers.

Figure 4B:
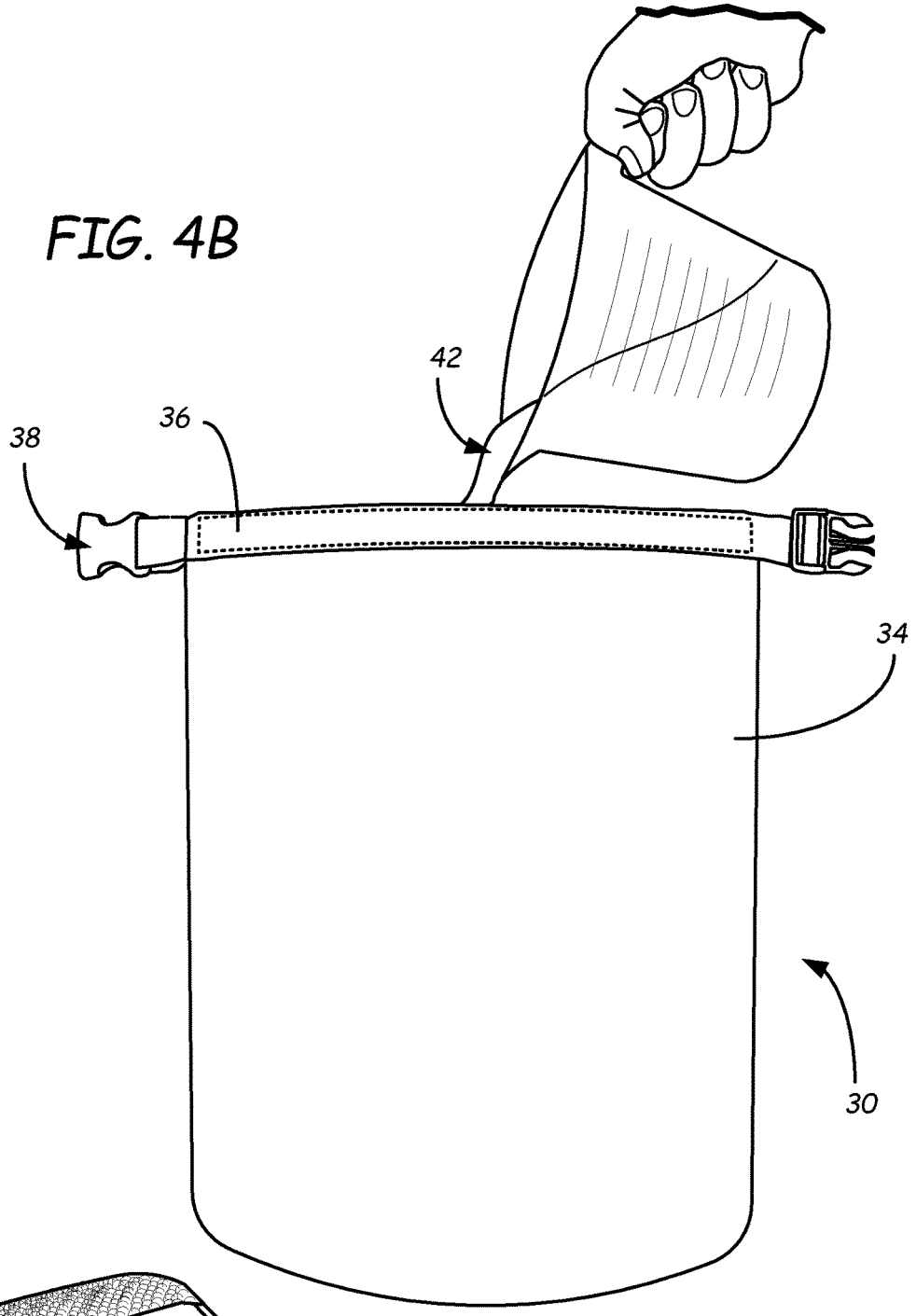
FIG. 4B illustrates filling the weight bag with a filler material.

Referring to FIGS. 4A-4B, the removable weights 30A, 30B, 30C are each comprised of a weight bag 34 which is configured to receive a filler material 42 therein. Each weight bag 34 has one or more markings on a surface. The marking(s) are "fill line(s)" corresponding to a total weight once the weighted filler material 42 is added to the bag 34. The weight bags are configured to receive an amount of the filler 42, such as sand. The user fills the weight bag 34 to a fill level indicating a selected total weight of the respective removable weight 30A, 30B, 30C. The sand 42 provides volume and weight to the removable weight 30A, 30B, 30C, forming the soft sided kettlebell 30A, 30B, 30C. For example, the weight bags 34 are configured with fill lines to indicate a 10 pound, 15 pound and 20 pound kettlebell weight, respectively.

Each of the removable weights 30A, 30B, 30C, when filled with the material 42 and stacked one on top of the other within the cavity 22 of the outer bag 12 has substantially the same shape and diameter, however the height of each weight bag varies. This allows the weights to be stacked inside the cavity 22 of the outer bag 12 flush with one another as the handle is pushed down towards to the body of the weight 30. The shape of the removable weights 30 and their ability to stack one on top of each other within the cavity of the outer bag 12 allows the total weight to be evenly distributed through the bag 12.

An opening 36 of the weight bag 34 includes clasps 38 for closing the weight bag when filled with sand 42. A nylon or polyester webbing 37 extends along the opening 36 of the bag. Terminal ends of this webbing 37 comprise each interlocking clasps 38, as the clasps 38 extend beyond the opening 36 of the weight bag 34. The clasps 38 can be connected to secure the contents of the weight bag 34 therein, and to form a handle 32 of the removable weight 30A, 30B, 30C while maintaining the kettlebell shape of the formed weight 30A, 30B, 30C. While a clasp is disclosed as a closing mechanism for each weight bag, other interlocking or closing mechanisms are within the scope of this disclosure.

Figure 5B:
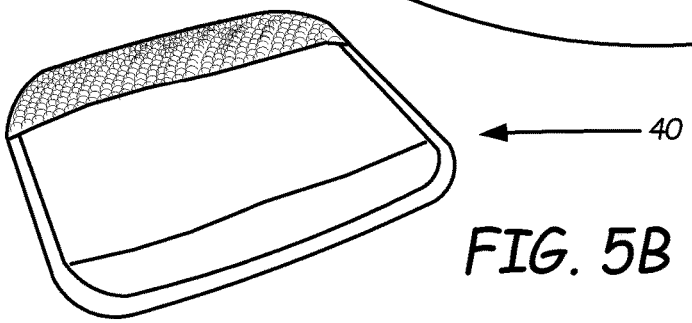
FIG. 5B is perspective view of the removable handle in an open manner for use with an assembled removable weight as illustrated in FIG. 3.

As illustrated in FIGS. 4-6, each of the removable weights 30A, 30B, 30C includes the handle 32. The kit 10 also includes a removable handle cover 40. The removable handle cover 40 reinforces the handle 32 formed when closing the weight bag 34 filled with sand 42. The handled formed is generally a pliable but wear resistant material, to promote comfort and grip in use. The handle cover 40 includes foam pad having a fabric material cover where the handle cover is foldable and reusable. The handle cover 40 includes a hook and loop fastening mechanism on opposing edge for folding the cover 40 over the handle 32 and securing the cover thereto.

Each removable weight 30A, 30B, 30C may be assembled by filling a respective weight bag 34 with a selected amount of sand 42 corresponding the selected total weight of the respective weight 30A, 30B, 30C and folding over the opening 36 of the bag 34 about the webbing 37 and around the webbing 37, at least one time about. The weight bags 34 are compressed when folded down and over the webbing 37 towards the volume of sand 42, excess air is forced from the weight bag 34 through the opening 36. The opening 36 of the weight bag 34 may then be rolled down about the webbing 37 one or more times. Once the upper portion has been rolled down substantially to the sand 42 fill level, the opposing ends of the weight bag 34 closure 38 are secured or connected, thus forming the handle 32.

These removable weights 30A, 30B, 30C, may then be used individually, for example, as kettlebells or one or more of the removable weights 30A, 30B, 30C may be stacked into the outer bag 12, the cover 13 secured to the outer bag 12 in a closed manner and the multi-use exercise bag used with any combination of handles 11, 14, 15, 16.

When all three weights 30A, 30B, 30C are stacked into the outer bag 12, the weights fit snugly therein as the weights 30A, 30B, 30C have substantially the same dimensions, with the exception of varying heights as discussed previously above. Thus, the total weight is evenly distributed in the bag 12. It is possible that two of the three weights 30 may be stacked in the outer bag 12 to select a different total weight of the bag 12. In stacking two weights, a filler fabric, such as a towel, can be inserted above, below, or between the two weights to pack the weights within the outer bag 12 and account for open space attributed to the lack of the third weight.

In one embodiment, the outer bag 12 itself, when empty, weighs approximately 5 lbs. Each weight bag 34 weighs approximately ½ lb. each. Thus, the system 10 when shipped weights approximately 6½ lbs. A user then may fill each weight bag 34 with sand, such that the user has different weight kettlebells, for example, approximately 10 lbs., 15 lbs., and 20 lbs. respectively. When all three removable weights 30A, 30B, and 30C are stacked within the outer bag 12, the total weight of the system is approximately 50 lbs. However, it is possible to place only two weights 30A, 30B, 30C into the outer bag 12 such that the system has an overall weight of approximately 30 lbs, 35 lbs, or 40 lbs, evenly distributed through the outer bag 12, with a material layer to account for the space from the missing weight as described above.

Although the present disclosure has been described with reference to preferred embodiments, workers skilled in the art will recognize that changes may be made in form and detail without departing from the spirit and scope of the disclosure.

The invention claimed is:

1. A multi-function exercise kit comprising:

an outer bag having a cover and a cavity therein configured to receive one or more removable weights stacked therein, wherein the outer bag has a plurality of spaced apart handles fixedly secured to an exterior surface thereof;

a plurality of weight bags, each weight bag having a closure mechanism secured thereto and the weight bags each configured to receive a selected amount of a material to provide a selected weight thereto, wherein one or more of the weight bags form the one or more removable weights when the one or more of the weight bags are closed, and wherein the one or more removable weights have an integrally formed handle, wherein the closure mechanism of each weight bag has interlocking ends and extends along a length of an opening of each weight bag and wherein the closure mechanism forms the integral handle when the ends interlock; and wherein the plurality of handles fixedly secured to the outer bag comprise at least one handle positioned longitudinally along the exterior surface of the outer bag and at least one handle positioned latitudinally along the exterior surface of the outer bag, such that the outer bag comprises a plurality of handle configurations for various exercises.

2. The exercise kit of claim 1, wherein the cover is secured to a loading end of the outer bag by a zipper connection.

3. The exercise kit of claim 1, wherein the outer bag further comprises a liner secured to an inner surface of the outer bag and defining the cavity therein.

4. The exercise kit of claim 1, wherein an outer layer of the outer bag is comprised of vinyl, nylon, polyester, leather, canvas or a combination thereof.

5. The exercise kit of claim 1, wherein each weight of the one or more removable weights is a soft-sided kettlebell having a selected weight, wherein the selected weight of each removable weight is different from at least one other weight.

6. The exercise kit of claim 1, and further comprising a removable pad for surrounding the integral handle of the weight bag for gripping.

7. The exercise kit of claim 1, wherein the plurality of handles of the outer bag comprise at least one pair of handles, wherein the handles in the pair of handles are positioned parallel to one another and spaced apart from one another.

8. The exercise kit of claim 1, wherein the plurality of handles comprise at least one pair of handles wherein the handles in the pair of handles are linearly aligned with one another.

9. The exercise kit of claim 1, wherein each weight bag of the plurality of weight bags comprises a fill level marking corresponding to a selected weight.

10. A method of using a kit for multiple exercises comprising:

filling a plurality of weight bags with a filling material to a selected fill level indicated on a surface of each of the weight bags for forming a plurality of removable weights;

gripping a handle portion of one of the plurality of weights for lifting the weight for exercising;

providing an outer bag, wherein the outer bag has a cover and a cavity therein that is configured to receive the plurality of removable weights therein;

stacking one or more of the plurality of removable weights into the outer bag;

closing the outer bag with one or more of the plurality of removable weights stacked therein;

gripping one or more spaced apart handles secured to an outer surface of the outer bag for lifting the bag for exercising;

folding over an opening of each weight bag at least one time;

compressing the weight bag to force excess air from the weight bag;

rolling down the folded over opening one or more times; and securing together a first and a second end of an interlocking closure mechanism that extends across the opening of the weight bag wherein the first and second ends extend beyond opposing ends of a length of the opening.

11. The method of claim 10, and further comprising forming an integral handle of each weight bag and wrapping a pad around a length of the weight bag formed between the interlocked first and second ends of the closure mechanism.

12. The method of claim 10, wherein the outer bag comprises a liner secured to an inner surface of the outer bag and defining a perimeter of the cavity of the outer bag, wherein the liner is a padding configured to provide rigidity to and maintain the shape of the outer bag.

13. The method of claim 10, wherein closing the outer bag further comprises forming a weighted outer bag having a selected weight.

14. The method of claim 10, wherein the outer bag comprises at least one handle extending along a length of the bag between opposing ends of the outer bag.

15. The method of claim 10, wherein the outer bag comprises at least one pair of handles facing one another and positioned on opposing ends of the outer bag.

* * * * *